US005309674A

United States Patent [19]

Weibel

[11] Patent Number: 5,309,674

[45] Date of Patent: May 10, 1994

[54] PARKING PROHIBITION DEVICE

[76] Inventor: Clemens Weibel, Chemin de Corgeon 6, CH-1095 Lutry, Switzerland

[21] Appl. No.: 859,315

[22] PCT Filed: Sep. 24, 1991

[86] PCT No.: PCT/CH91/00202

§ 371 Date: May 27, 1992

§ 102(e) Date: May 27, 1992

[87] PCT Pub. No.: WO92/06247

PCT Pub. Date: Apr. 16, 1992

[30] Foreign Application Priority Data

Oct. 2, 1990 [CH] Switzerland ..... 3167/90

[51] Int. Cl.[5] ..... E01F 13/00

[52] U.S. Cl. ..... 49/49; 49/131; 404/6; 404/10

[58] Field of Search ..... 49/49, 35, 131, 132, 49/133, 134; 404/6, 9–11

[56] References Cited

U.S. PATENT DOCUMENTS 3,442,187 5/1969 Hausegger .
3,748,782 7/1973 Reynolds .
4,822,206 4/1989 Roussel et al. ..... 404/6
4,974,991 12/1990 Mandavi ..... 49/49 X

FOREIGN PATENT DOCUMENTS 1177299 11/1984 Canada .
0042810 12/1981 European Pat. Off. .
0112804 7/1984 European Pat. Off. .
0276504 8/1988 European Pat. Off. .
2124197 9/1972 France .
664587 3/1988 Switzerland .
2245296 1/1992 United Kingdom ..... 49/49

*Primary Examiner*—Philip C. Kannan
*Attorney, Agent, or Firm*—Woodard, Emhardt, Naughton, Moriarty & McNett

[57] ABSTRACT

A parking prevention means comprises a housing (1) containing a power supply, a controller signal receiver unit, said signals controlling a motor coupled to a shaft (8) bearing a movable part (2) which the motor moves from a substantially horizontal position to a substantially vertical position and vice-versa. The movable part comprises one or more legs (3) which are substantially nondeformable and also includes means enabling the shaft to impart its rotational movement to the movable part, whereas rotation of the movable part caused by an external force does not result in associated rotation of the shaft.

15 Claims, 6 Drawing Sheets

Fig. 1
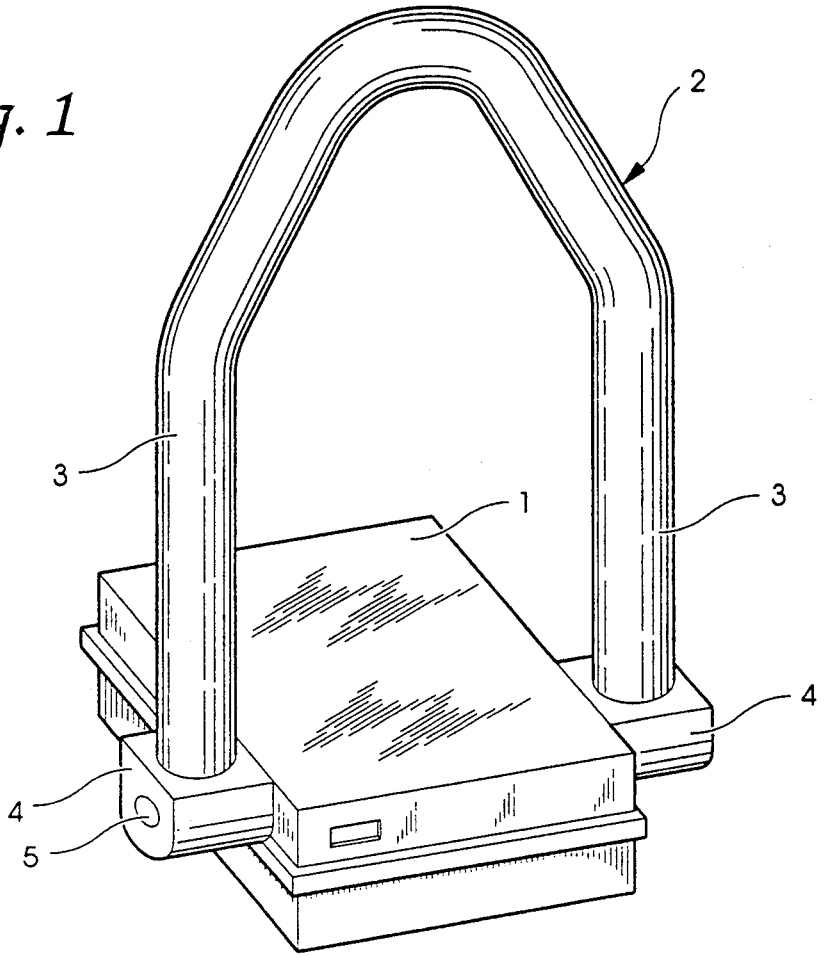
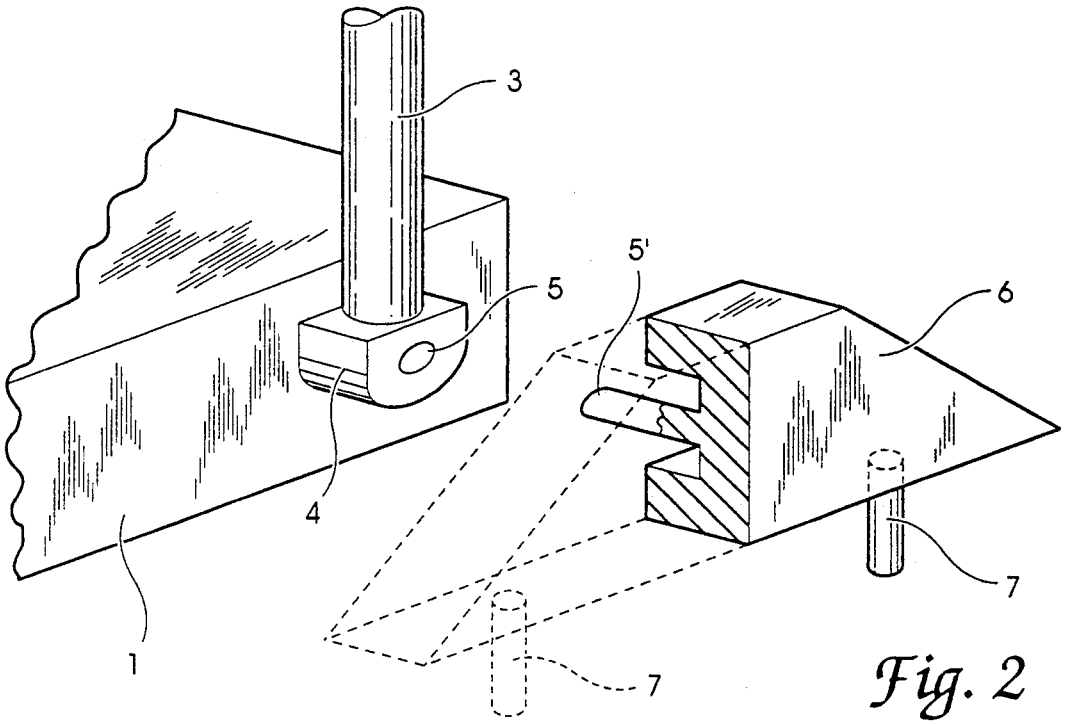
Fig. 2

PARKING PROHIBITION DEVICE

The present invention concerns a parking prohibition device.

The reservation of a motor vehicle parking place is a subject which has already given rise to very many proposals. These proposals may be distinguished according to two main criteria.

The first criterion refers to the remote control of the device. Indeed certain devices assume a manual intervention by the user whilst others provide on the contrary a remote control.

The second criterion concerns the signalling effect or the physical opposition effect.

To a large extent the devices proposed suffice to indicate, as clearly as possible, that the driver searching for a place is asked to look somewhere else. If the impatient motorist decides to violate the signal, the constitutive characteristics of the devices concerned aim especially at the device surviving the violation.

The other group is of course constituted by devices conceived to be physically the most inviolable possible.

It being a matter of devices offering a certain physical resistance the question to be solved is mainly avoiding a violation involving damage of the unbolting mechanism. Indeed, when such is the case the device prohibits access to the place to any third party as well as to its rightful owner.

For devices providing for a remote control and a physical resistance, a second problem arises: the protection of the indispensable electronic elements as well as of the supply batteries if they are provided. Indeed, electronics and supply are confined in the case of the device which generally diminishes the resistance to crushing, in particular if the wheel of a van or of a lorry passes over the device.

Finally, according to the philosophy adopted, with or without remote control the known devices aim either at preventing at all costs any violation or protecting, as much as can be, the device, if a violation takes place. The first risk destruction or damage, the second have purely psychological dissuasive effect which diminishes in the course of time and the experience of the offenders.

As illustration of the devices proposed, we cited, for example, French patent published under No. 2124197 and Belgian patent No. 904603 with regard to purely signalling devices. Swiss patent No. 664587 illustrates a remote control signalling device provided with means for the protection of the device in case of violation. Finally, Canadian patent No. 1177299 shows manual action devices having means for absorbing unintentional impacts.

This list is not intended to be exhaustive but simply representative of the various types of known proposals.

Generally speaking, one can retain, if they are conceived to survive a violation, the known systems employed to avoid a loading by the offending vehicle and that when the vehicle enters the place reserved as well as when it leaves. Consequently the perpetrators of the violations have little to fear from their behaviour, the parts of the prohibition devices being conceived so as not to damage them. That applies quite particularly at the time of departure of the vehicle, a moment when an actual resistance of the prohibition device could lead to a lifting effect which the known devices do not resist.

The present invention aims at proposing a device permitting of remedying to a great extent the drawbacks mentioned above.

For this purpose the parking prohibition device comprises a case enclosing feeding means, a control signals receiving member which actuates a motor coupled to a shaft bearing a movable part which the action of the motor causes to pass from a substantially horizontal position to a substantially vertical position and vice-versa. It is characterised in that it comprises means allowing the forced lowering of the movable part in the event of violation and ensuring its return to the vertical position, these means being formed so that the movable part acts like a crutch lifting the offending vehicle at the time of its withdrawal without damage to the device resulting therefrom.

One example of the device according to the invention is described in the following with reference to the drawings in which:

FIG. 1 shows a total view of the device, in perspective;

FIG. 2 shows in detail one of the lateral struts of the device;

Figure 3:
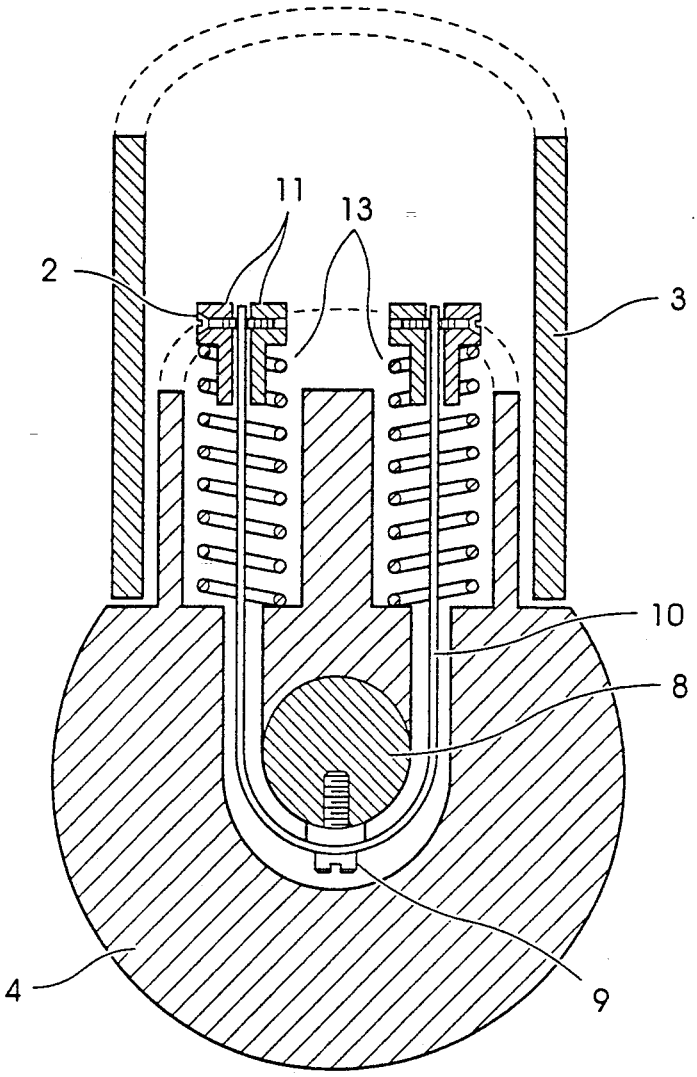
FIG. 3 shows a first variation of the joining between the pivoting shaft and the leg of the movable part.

As shown in FIGS. 1 to 7, the device is composed of a case 1 made of resistant material. Inside the case is placed a control member capable of receiving signals 21. This control member starts a motor 22 the axle 23 of which is coupled to a cam 24 which actuates a rod 25 connected to a shaft 8 by means of a second cam 26. The shaft rests in orifices made in the walls of the case and goes beyond the latter on both sides. On the ends of the shaft 27 which go beyond the case are diposed sleeves 4 in the form of caps on which are fixed in their turn the legs 3 which constitute the base of the movable part 2 of the device. In its normal use, that is, without violation, the remote control 21 activates the motor 22 which causes the shaft 8 to turn on itself as far as a preferential position of stable equilibrium determined by the cams 24 of the motor axle 23, the movable part 2 of the device then being placed in vertical position. A spring 28 holds the rod 25 in this preferential position. When the owner of the parking place provided with the device returns to park his vehicle there, he operates again the remote control and the motor acting On the shaft bringing the movable part back again into a horizontal position.

If a violation takes place the offending vehicle transmits to the movable part of the device a force tending to cause it to regain its horizontal position. By reason of the stable position of equilibrium described, the shaft cannot turn on itself and allow this movement. The folding movement certainly takes place but owing to an arrangement permitting one or several springs lodged in the legs of the movable part to absorb the stroke of the movable part. The movable part thus gives way under the advancement of the vehicle but the top of the movable part rests against the lower part of the vehicle with the whole force of the spring or springs. Consequently when the offending vehicle starts its withdrawal attempt, the movable part pivots according to the axis of the shaft and constitutes a crutch capable of lifting up the vehicle. The device thus has an appreciable advantage in forcing the offending vehicle to remain in place on pain of being damaged. The device, by the constructional measure suited to it and which are detailed hereinafter, supports perfectly this treatment without any damage. The originality of the device follows from the fact that the means implemented for raising and lowering without violation the movable part are not at all affected in case of violation, the folding movement of the movable part then being taken over completely by other means.

In FIG. 1 can be seen the case 1 which comprises a mechanism permitting of raising the movable part 2. The legs 3 of the movable part are anchored on the shaft, not visible in this Figure, by means of sleeves 4. The movable part 2 is shown here in its active position and can be turned back by turning around the case until parallel with the upper surface of the latter. An orifice 5 made in the sleeve 4 can also be seen. This orifice is in the extension of the shaft.

FIG. 1 shows the device as seen in front if one is in front of the parking place concerned. Account is thus taken of the fact that a vehicle violating the access would rest against the movable part 2 until folding it back almost completely.

Figure 4:
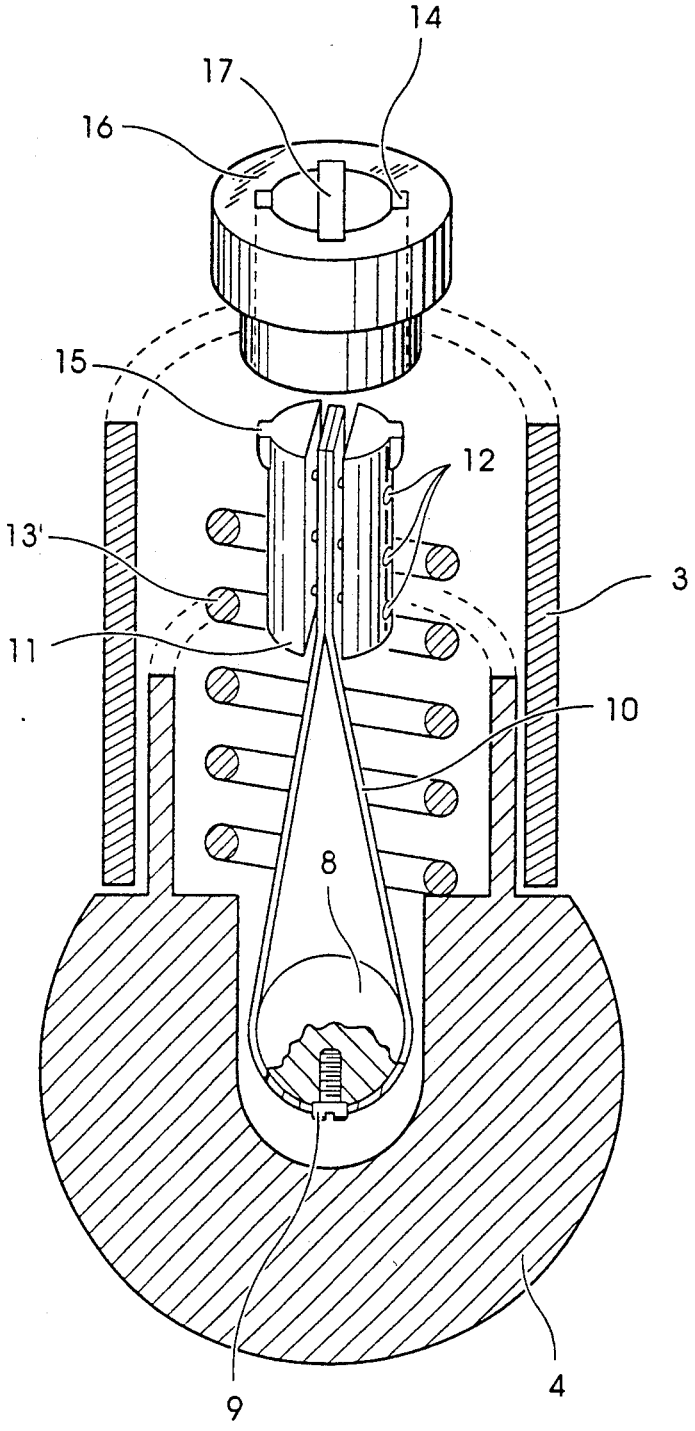
FIG. 4 shows a second variation of the joining between the pivoting shaft and the leg of the movable part.
Figure 5:
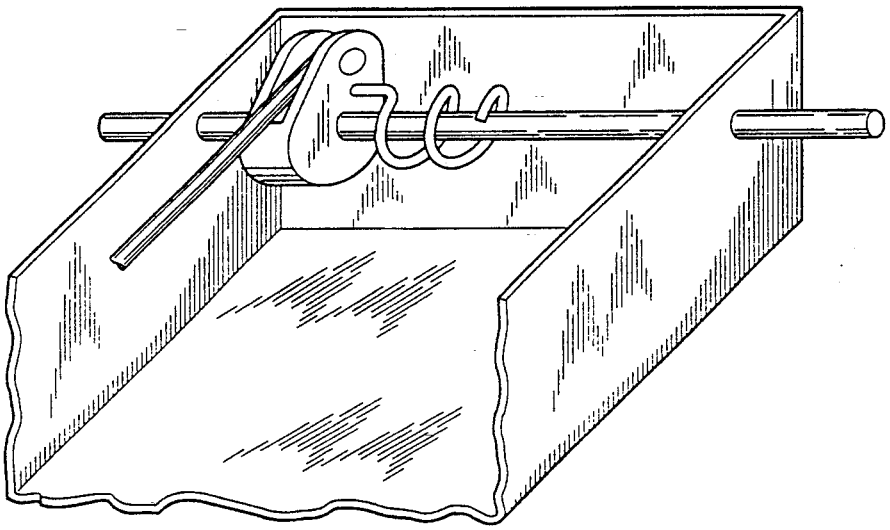
FIG. 5 shows a variation in which the impact absorption means is disposed on the shaft inside the case.

When thus engaged on the parking place the offender will reverse in order to withdraw, the top of the movable part, which is held in contact with the underside of the vehicle due to the springs described in FIGS. 3 to 5, is in position to act as a lever. The whole force resulting from this resistance is transmitted to the shaft according to its axle due to the mechanisms illustrated in FIGS. 3 to 5.

FIG. 2 illustrates a lateral strut 6 which presents itself like a kind of shoe anchored in the ground by solid pins 7. The lateral strut which is shown here in partial section in order to draw attention to its details in position, has a crown shaped cavity the shape of which constitutes substantially the impression of the sleeve 4. In fact and that is the important thing, a protuberance 5' corresponds exactly to the orifice 5 already described. As this orifice constitutes the extension of the shaft, the shaft has an outer support which shares the loads to which it is subjected thus contributing to transmit these forces to the ground on a base larger than only the case. It is likewise provided for fitting the device with a strut different from that illustrated in FIG. 2. In this case the strut simply follows the exact outer contour of the sleeve on its lower half like a simple stirrup-piece.

FIG. 3 permits of observing an arrangement permitting of transmitting the force resulting from a violation according to the axle of the shaft so as to permit the transmission of the said forces to the ground without any internal mechanical effort. One recognizes the sleeve 4 in the interior of which a cavity shields a passage for a strap 10 made of flexible material but very resistant and non extensible such as Kevlar braid or glass fibre. The strap 10 is in the form of a narrow band the middle part of which is fixed to the shaft 8 by a screw 9 and the ends of which are confined between two clamping jaws 11 connected by clamping screws 12. The jaws 11 have a supporting edge on which springs 13 rest. Whether one presses on the movable part towards the front or towards the rear, the opposing force developed by the extension of one spring and the crushing of the other is transmitted axially to the shaft. Since the shaft cannot pivot on itself by reason of the position of maximum length of the cam which controls it, the sleeve 4 pivots around the shaft only meeting the relative resistance of the two springs. The opposed play of the springs permits the movable part to regain its neutral vertical position without that involving any movement of the shaft therefore of the driving mechanism of the device.

In FIG. 4 is seen a second variation of an arrangement permitting a transmission of the external forces according to the axis of the shaft. This time, a single spring 13' is used which presents the possibility of giving it a greater length of stroke. The same components as in FIG. 3 are recognized. Furthermore, this arrangement comprises a fixing ring 16 provided with grooves 14 intended to collaborate with lugs 15 made on the jaws 11 which fix between them the ends of the strap 10. In fact, at the time of mounting the device the lugs 15 are caused to slide in the grooves 14 until the lugs 15 are flush above the upper surface of the ring 16. At this moment the ring, respectively the jaws, are caused to pivot by a quarter of a turn so that the lugs are located opposite loopholes 17 and penetrate into these. The spring thus being set, the lugs can no longer come out again from the loopholes under the opposed action of the strap and of the spring.

FIG. 5, very diagrammatic, permits of establishing that an effect similar to that described with regard to FIGS. 3 and 4 may be obtained even inside the case by ensuring the connection between the cam of the shaft and the shaft by means of a spring one of the ends of which is solid with the shaft and the other with the cam of the shaft which is connected to a rod fixed at its other end to the cam of the axle of the motor. In this case at the time of a violation there is a rotation of the shaft but without the latter being reflected back to the driving mechanism, the movement of the shaft being absorbed by the spring.

Tests made with vehicles of different kinds show that, realised according to one of the variations set forth in FIGS. 3 to 5, the device is capable of lifting one of the axles of the offending vehicle without undergoing the slightest damage, that being due to a transmission of the forces according to the axis of the shaft. The whole of the forces resulting from an attempt to withdraw the offending vehicle is transmitted to the ground without any torsion effect putting in danger the functional structure of the device. The transmission of the said forces to the ground is furthermore facilitated by the action of the lateral struts. The variation illustrated in FIG. 4 may be considered as preferential.

Figure 6:
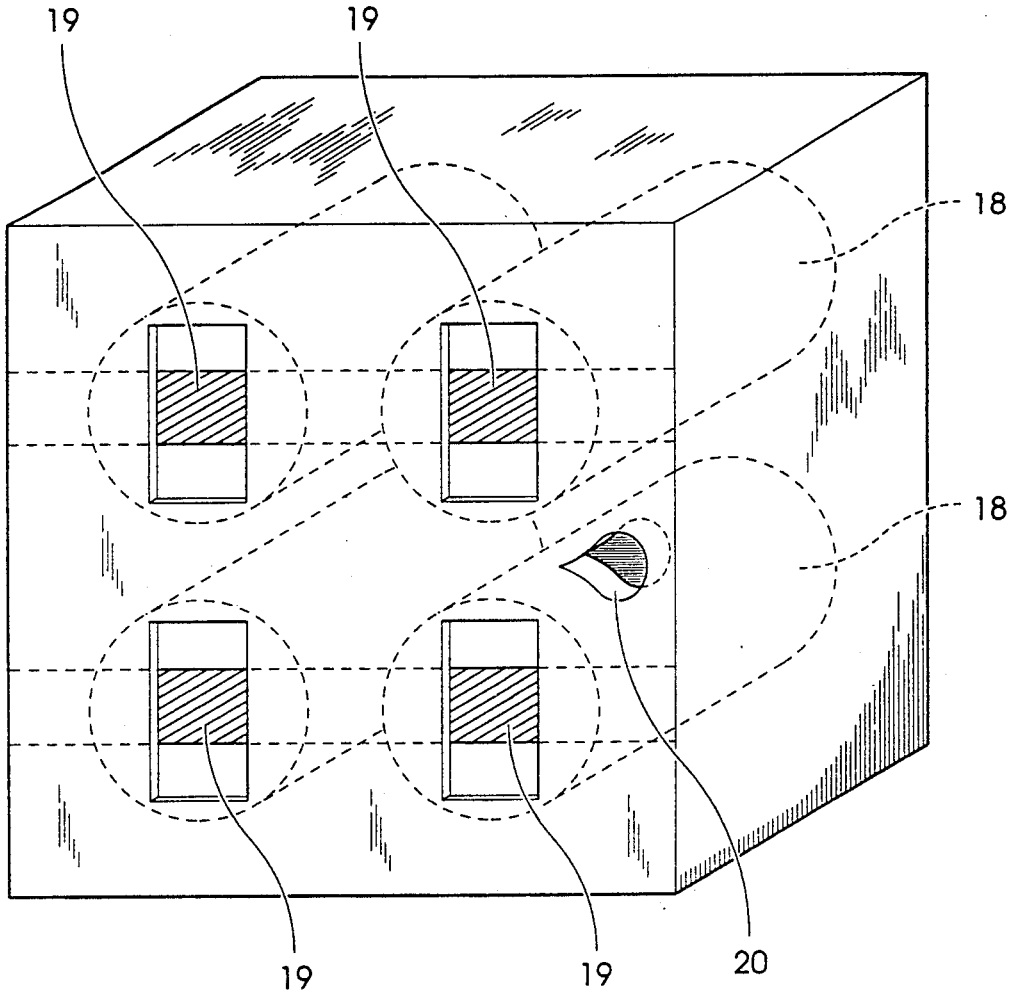
FIG. 6 shows two parts of an energizing block comprising a resistance to crushing structure constituting a magazine for the batteries or cells.

FIG. 6 shows an energizing block which presents itself in the case in question as a cube in which cells usual in the trade 18 are placed. It must be clear that the shape shown of the energizing block is purely by way of indication. The material used for the realization of the cubic casing receiving the cells will be selected with non-conducting properties but especially with resistance to compression. In fact, as the energizing block is placed at the centre of the case it participates very actively in the resistance to crushing of the latter. The dimensions of the casing are selected so that the cells have a small margin of freedom, precisely so that a slight deformation of the casing does not destroy the cells.

In FIG. 6, the face of the cube shown is the lower face at the time of putting the energizing block in place in the case. The case, which is better seen in FIG. 7 comprises at its centre a housing 30 intended to receive the energizing block. This housing constitutes in some way the mould of the energizing block. The face illustrated in the drawing of FIG. 6 will therefore be turned towards the ground. Supposing that an exterior feeding is possible it is obvious that one could replace the energizing block by a feed converting the current. Care will then be taken to see that the feed container exercises the same function of central support as that of the energizing block described. One recognises four cells 18 placed in contact in series by means of contact strips 19 arranged on the inner face of the cubic casing. It is advisable to insist quite particularly on the fact that the contact straps are situated, as the drawing indicates, on the inner face of the cubic casing. The consequence of that is that once the energizing block is put in place in the case, the contact strips are not only separated from the lower surface of the case but are separated therefrom by a space at least equal to the thickness of the casing. This recessed placing of the contact strips has the object of eliminating the risk of short-circuit which would arise from the presence of deposits or liquid at the bottom of the case resulting, for example, from condensation. Thus, the elements contributing to the contact of the cells between them or with the terminals provided by the case are neither in contact with the lower inner face of the case nor even situated in immediate proximity to this surface.

Figure 7:
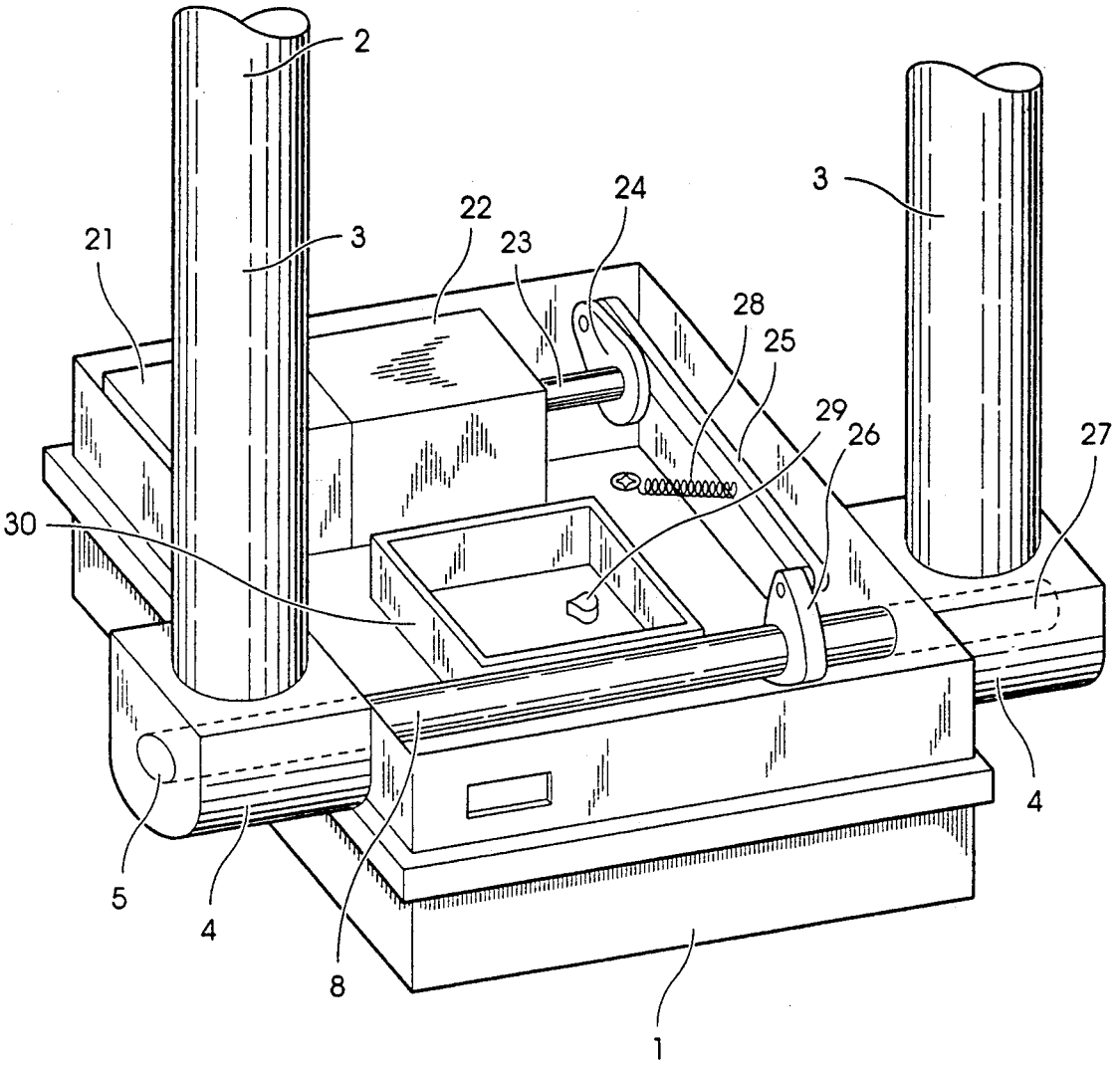
FIG. 7 shows the interior arrangement of the case.

Finally attention is called to a recess 20 shaped so as to collaborate with a corresponding male part 29 present on the inner lower face of the case as seen in FIG. 7. The coupling, male 29, female 20, has the object of rendering possible only one single manner of placing the energizing block in place, precisely that which permits of matching with the contact strips which the upper part of the case comprises.

The upper face of the energizing block is quite similar to the lower face seen in FIG. 6 except that there are neither contact strips 19 nor recess 20.

The advantages of the device according to the invention are to give a parking prohibition device which not only draws attention to but opposes any attempted violating not at the time of the entering of the vehicle but at the time of its withdrawal. Of course these advantages are obtained without damage to the device, even with an angle of attack perpendicular to the device, i.e. side-face, which is not usual. As corollary, the vehicles trapped, not being able to withdraw normally, the device is called upon to have to resist the weight of the vehicle transmitted by one of its wheels on the upper surface of the case. Here again the device according to the invention shows robustness in presenting increased resistance at the centre of the case even though this place conceals the cells or batteries which cannot participate in any way in the force on pain of being seriously damaged, indeed destroyed.

I claim:

1. A parking prohibition device, comprising a case enclosing a shaft carrying a movable part having at least one leg, which the rotation of the shaft causes to pass from a substantially horizontal position to a substantially vertical position and vice-versa, and further comprising means allowing the forced lowering of the movable part in case of violation while the shaft remains immobilized in the position which it occupies when the movable part is in a vertical position and said means further ensuring the return of the movable part to the vertical position, these means being formed so that the movable part acts like a crutch forming obstruction to the withdrawal of a violating vehicle that, in an extreme case, lifts an offending vehicle at the time of its withdrawal without rotating the shaft and without damage to the device.

2. A device according to claim 1, wherein the case comprises two orifices in which rests the shaft which extends to the outside of the case at both sides of the latter the outer ends of the shaft receiving sleeves on which the movable part is fixed through at least one leg.

3. A device according to claim 2, wherein the sleeves are supported by lateral struts.

4. A device according to claim 2, and further comprising means arranged so that the rotation of the shaft entails the rotation of the sleeves at the time of normal control of the device and permit, in case of violation, the sleeves to pivot around the shaft without driving the latter.

5. A device according to claim 4, wherein there are two legs, and the legs have a hollow cylindrical form and are solid with the sleeves.

6. A device according to claim 5, wherein the sleeves are partially truncated in a plane parallel to the shaft and have an opening which leads to the inside of each leg.

7. A device according to claim 6, wherein at least one spring is accommodated in the inside of at least one leg and in that the first spire of the spring rests on the surface which borders the opening of the sleeves.

8. A device according to claim 7, and further comprising two strands of a flexible but non-extensible strap fixed at its middle to the shaft and enveloping the latter extending into the interior of the legs, the ends of the two strands comprising means for the putting in collaboration of the strap with the spring or springs.

9. A device according to claim 8, wherein the spring or springs put the strap in tension such that in the absence of exterior constraint, the rotation of the shaft is reflected back to the movable part by its legs.

10. A parking prohibition device according to claim 9 wherein said case encloses a receiving member for control signals that actuate a motor coupled to the shaft carrying the movable part, which the action of the motor causes to pass from a substantially horizontal position to a substantially vertical position and vice-versa, and further comprising means allowing said forced lowering of the movable part without the action of the motor in case of violation and ensuring its return to the vertical position, wherein the motor is coupled to the shaft through means permitting immobilization of the shaft in the position which it occupies when the movable part is in the vertical position, and the motor has an axle, and the axle is coupled to a cam at the end of which is fitted a rod whose opposite end is fastened to a second cam solid with the shaft so that the cam solid with the axle of the motor is in the extreme position when the movable part is in vertical position and is held in this position by a return means.

11. A device according to claim 10, and further comprising an energizing block constituting at the same time a magazine for cells and a supporting structure for the central part of the case without the cells or their contacts receiving any share of compression in the case where a vehicle runs over the device.

12. A device according to claim 11 wherein the energizing block is constituted by a casing resistant to compression, in the inside of which not only the cells but likewise their contacts are placed.

13. A device according to claim 12, wherein the energizing block is formed so that the cells are in vertical position when the block is placed in the case and in that the members putting in contact the lower poles of the cells between one anther are distant from the inner lower surface of the case by at least the thickness of the energizing casing.

14. A device according to claim 13, wherein the sleeves are cylindrical in shape and are truncated in a plane parallel to the axis of the cylindrical sleeves so as to give a planar surface on which the first spire of a spring comes to rest as does at least one leg of the movable part the section of which is circular hollow; the sleeve further comprising a central hollow in which the shaft is fitted and an opening, leading into the plane surface, through which the two strands of said strap fixed at its middle to the shaft by means of a screw can extend in the inner space described by the spring, the ends of the two strands being fixed to one another by the combined play of two jaws and a clamping screw, the jaws comprising lugs intended to cooperate with corresponding grooves made in the central channel of a ring likewise provided with loopholes intended to receive the lugs and to prevent the ring from being able to break away from the joined ends of the strip under the action of the spring, which, put in tension to permit the penetration of the joined ends in the ring, tend to hold the lugs captive of the loopholes such that any force applied from outside onto the movable part is transmitted through at least one leg to the sleeve, then to the spring, then to the strap and finally to the shaft about its axis only, with the exclusion of forces applied along the axis of the shaft and in a plane passing through the top of the movable part and perpendicular to the axis of the shaft so that whatever the orientation of the force applied on the movable part, this force is transmitted to the ground without there being any mechanical effort or moment on the shaft and its motor parts.

15. A device according to claim 14, wherein the sleeves are supported by lateral struts.

* * * * *